US011346249B2

(12) United States Patent
Lefebvre et al.

(10) Patent No.: US 11,346,249 B2
(45) Date of Patent: May 31, 2022

(54) GAS TURBINE ENGINE WITH FEED PIPE FOR BEARING HOUSING

(71) Applicant: PRATT & WHITNEY CANADA CORP., Longueuil (CA)

(72) Inventors: Guy Lefebvre, St-Bruno-de-Montarville (CA); Remy Synnott, St-Jean-sur Richelieu (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 373 days.

(21) Appl. No.: 16/292,407

(22) Filed: Mar. 5, 2019

(65) Prior Publication Data

US 2020/0284161 A1 Sep. 10, 2020

(51) Int. Cl.

| | |
|---|---|
| ***F01D 25/12*** | (2006.01) |
| ***F01D 9/06*** | (2006.01) |
| ***F01D 1/02*** | (2006.01) |
| ***F01D 11/06*** | (2006.01) |

(52) U.S. Cl.

CPC ..... *F01D 25/125* (2013.01); *F01D 1/02* (2013.01); *F01D 9/065* (2013.01); *F01D 11/06* (2013.01)

(58) Field of Classification Search

CPC . F01D 11/06; F01D 9/065; F01D 1/02; F01D 25/125; F01D 25/162; F01D 25/12; F01D 25/16

See application file for complete search history.

(56) References Cited

U.S. PATENT DOCUMENTS

| | | | | |
|---|---|---|---|---|
| 5,088,277 | A | 2/1992 | Schulze | |
| 5,326,222 | A | 7/1994 | Matyscak et al. | |
| 5,622,438 | A | 4/1997 | Walsh et al. | |
| 6,609,375 | B2 * | 8/2003 | Allen | F01D 25/12 60/608 |
| 7,124,572 | B2 * | 10/2006 | Aycock | F01D 9/065 60/39.511 |
| 7,287,384 | B2 | 10/2007 | Fish et al. | |
| 7,493,769 | B2 | 2/2009 | Jangili | |
| 7,510,371 | B2 * | 3/2009 | Orlando | F02C 3/067 415/191 |
| 8,128,339 | B2 | 3/2012 | Kondo et al. | |
| 8,641,362 | B1 | 2/2014 | Liang | |
| 8,894,359 | B2 | 11/2014 | Munshi et al. | |
| 9,091,171 | B2 * | 7/2015 | Rodriguez | F01D 9/065 |
| 9,279,341 | B2 | 3/2016 | Durocher et al. | |
| 9,546,567 | B2 | 1/2017 | Kasibhotla et al. | |

(Continued)

FOREIGN PATENT DOCUMENTS

| | | |
|---|---|---|
| CA | 2307577 A1 | 5/1999 |
| CA | 2660211 C | 2/2008 |

(Continued)

*Primary Examiner* — Courtney D Heinle
*Assistant Examiner* — Andrew Thanh Bui
(74) *Attorney, Agent, or Firm* — Alexandre Daoust

(57) ABSTRACT

The gas turbine engine can have a rotary shaft mounted to a casing via a bearing housed in a bearing housing, for rotation around a rotation axis, a gas path provided radially externally to the bearing housing, a feed pipe having a radial portion extending from an inlet end, radially inwardly across the gas path and then turning axially to an axial portion leading to an outlet configured to feed the bearing housing, the axial portion of the feed pipe broadening laterally toward the outlet.

16 Claims, 6 Drawing Sheets

(56) References Cited

U.S. PATENT DOCUMENTS

| | | | | |
|---|---|---|---|---|
| 9,605,592 | B2 | 3/2017 | Jewess | |
| 9,631,512 | B2 * | 4/2017 | Lockyer | F02C 6/08 |
| 9,732,628 | B2 * | 8/2017 | Cherolis | F01D 9/065 |
| 9,782,834 | B2 | 10/2017 | Kolluru et al. | |
| 9,803,502 | B2 * | 10/2017 | Cherolis | F01D 25/162 |
| 9,856,741 | B2 * | 1/2018 | Grant | F01D 9/042 |
| 9,856,750 | B2 * | 1/2018 | Farah | F01D 9/065 |
| 9,874,111 | B2 | 1/2018 | Stevens et al. | |
| 9,885,254 | B2 * | 2/2018 | Lienau | F01D 25/162 |
| 9,896,939 | B2 * | 2/2018 | Mateo | F02C 7/18 |
| 9,970,322 | B2 | 5/2018 | Suciu et al. | |
| 10,006,306 | B2 | 6/2018 | Scott et al. | |
| 10,094,285 | B2 | 10/2018 | Munshi et al. | |
| 10,100,730 | B2 * | 10/2018 | Huppe | F01D 9/065 |
| 10,145,255 | B2 | 12/2018 | Miller et al. | |
| 10,161,256 | B2 | 12/2018 | Porter et al. | |
| 10,161,264 | B2 | 12/2018 | Husband et al. | |
| 10,167,734 | B2 | 1/2019 | Sonokawa et al. | |
| 10,329,956 | B2 | 6/2019 | Scott | |
| 10,533,458 | B2 | 1/2020 | Tanimura et al. | |
| 2015/0354382 | A1 | 12/2015 | Pakkala et al. | |
| 2016/0102566 | A1 * | 4/2016 | Betancourt | F01D 9/065 415/1 |
| 2016/0208647 | A1 * | 7/2016 | Cherolis | F02C 7/12 |
| 2016/0222827 | A1 * | 8/2016 | Winn | F01D 5/02 |
| 2017/0067365 | A1 | 3/2017 | Mukhopadhyay et al. | |
| 2017/0067369 | A1 | 3/2017 | Hashimoto et al. | |
| 2017/0284225 | A1 | 10/2017 | Hashimoto | |
| 2017/0307019 | A1 | 10/2017 | Vicogne et al. | |
| 2018/0230850 | A1 | 8/2018 | Karstadt et al. | |
| 2018/0274443 | A1 | 9/2018 | Pointon et al. | |
| 2018/0340470 | A1 | 11/2018 | Stuart et al. | |
| 2019/0301302 | A1 | 10/2019 | Eastwood et al. | |
| 2020/0030924 | A1 | 1/2020 | Cabello et al. | |
| 2020/0032664 | A1 | 1/2020 | Beaujard et al. | |

FOREIGN PATENT DOCUMENTS

| | | | |
|---|---|---|---|
| CA | 2672096 | C | 10/2011 |
| CA | 2936674 | A1 | 1/2017 |
| CA | 2701405 | C | 2/2017 |
| CA | 2882565 | C | 5/2017 |
| CA | 2949010 | A1 | 5/2017 |
| CA | 2881774 | C | 10/2017 |
| CA | 2963407 | A1 | 10/2017 |
| CA | 2963409 | A1 | 10/2017 |
| CA | 3020816 | A1 | 10/2017 |
| CA | 2715227 | C | 11/2017 |
| CA | 2928979 | C | 6/2018 |
| CN | 204921169 | U | 12/2015 |
| CN | 205036457 | U | 2/2016 |
| CN | 102678334 | B | 8/2016 |
| CN | 104919140 | B | 3/2018 |
| CN | 105960511 | A | 3/2018 |
| CN | 106460550 | A | 4/2018 |
| CN | 109899177 | A | 6/2019 |
| CN | 110325713 | A | 10/2019 |
| EP | 1642009 | B1 | 4/2006 |
| EP | 1781900 | B1 | 6/2014 |
| EP | 2218892 | B1 | 7/2018 |
| EP | 2586701 | B1 | 12/2018 |
| EP | 2187019 | B2 | 3/2019 |
| EP | 2813685 | B2 | 4/2019 |
| EP | 2647801 | B1 | 5/2019 |
| EP | 2938859 | B1 | 5/2019 |
| EP | 2900998 | B1 | 6/2019 |
| EP | 2938847 | B1 | 8/2019 |
| EP | 3524779 | A1 | 8/2019 |
| EP | 2977739 | B1 | 11/2019 |
| FR | 3005097 | B1 | 7/2017 |
| GB | 884596 | A | 11/1956 |
| JP | 3072044 | B2 | 7/2000 |
| JP | 5529939 | B2 | 6/2014 |
| JP | 5710467 | B2 | 4/2015 |
| JP | 2018076857 | A | 5/2018 |
| KR | 20190006333 | A | 1/2019 |
| SG | 11201404962 | | 10/2014 |
| WO | 2017144207 | A1 | 8/2017 |
| WO | 2018146405 | A1 | 8/2018 |

* cited by examiner

GAS TURBINE ENGINE WITH FEED PIPE FOR BEARING HOUSING

TECHNICAL FIELD

The application related generally to gas turbine engines and, more particularly, to cooling thereof.

BACKGROUND OF THE ART

In gas turbine engines, rotary shafts holding compressor/fan and turbine blades are typically rotatably mounted within a casing via bearings. The bearings are typically located radially inwards relative to the annular flow path formed by duct walls of the casing. Bearings are continuously supplied with oil for lubrication. During operation, the oil mixes with air, and the oil is contained in a bearing cavity and recuperated. Seals can axially delimit the bearing cavity. A positive pressure can be maintained towards the bearing cavity, to prevent the air/oil mixture from crossing the seal in the opposite direction. In some cases, it is possible to supply the pressurized air to the seal along a supply path located radially internally to the main, annular flow path. However, in some cases, such supply paths are not readily available. There remained room for improvement.

SUMMARY

In one aspect, there is provided a gas turbine engine having a rotary shaft mounted to a casing via a bearing housed in a bearing housing, for rotation around a rotation axis, a gas path provided radially externally to the bearing housing, a feed pipe having a radial portion extending from an inlet end, radially inwardly across the gas path and then turning axially to an axial portion leading to an outlet configured to feed the bearing housing, the axial portion of the feed pipe broadening laterally toward the outlet.

In another aspect, there is provided a method of operating a gas turbine engine, the method comprising: conveying pressurized air along a radial portion of a feed pipe, across a gas path, and then turning axially, along an axial portion of the feed pipe, and out an axial outlet of the feed pipe.

DESCRIPTION OF THE DRAWINGS

Reference is now made to the accompanying figures in which.

DETAILED DESCRIPTION

Figure 1:
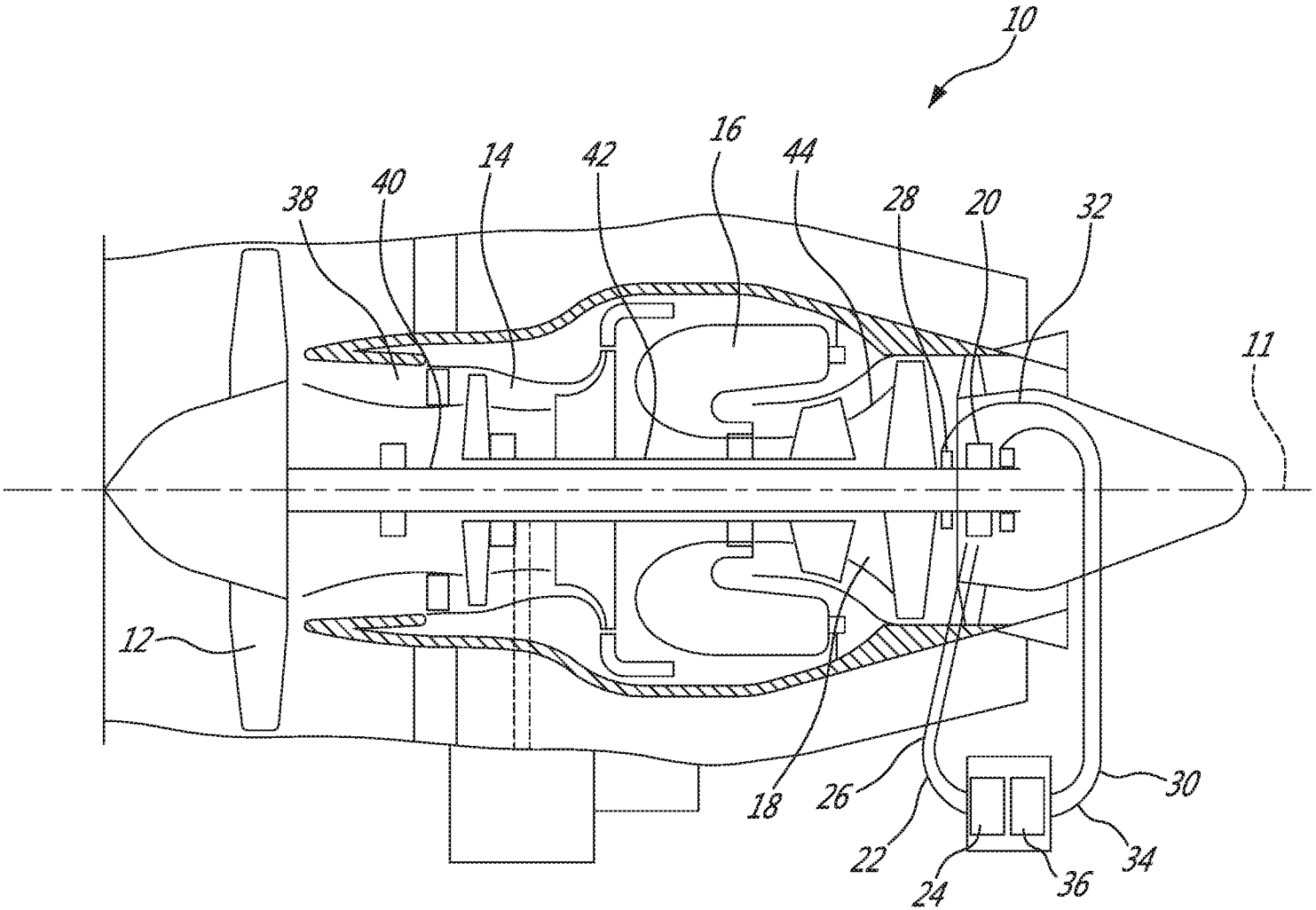
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. An annular gas flow path 38 extends sequentially across the fan 12, compressor section 14, combustor 16, and turbine section 18.

The compressor section 14, fan 12 and turbine section 18 have rotating components which can be mounted on one or more shafts 40, 42, which, in this embodiment, rotate concentrically around a common axis 11. Bearings 20 are used to provide smooth relative rotation between a shaft (40 or 42) and casing 44 (non-rotating component), and/or between two shafts which rotate at different speeds. An oil lubrication system 22 typically including an oil pump 24 and a network of oil delivery conduits and nozzles 26, is provided to feed the bearings 20 with oil. The bearings are housed in corresponding bearing cavities 32, which are typically terminated at both axial ends by seals 28, used to contain the oil. A scavenge system 30 typically having conduits 34, and one or more scavenge pumps 36, can be used to recover the oil from the bearing cavities 32.

Figure 2:
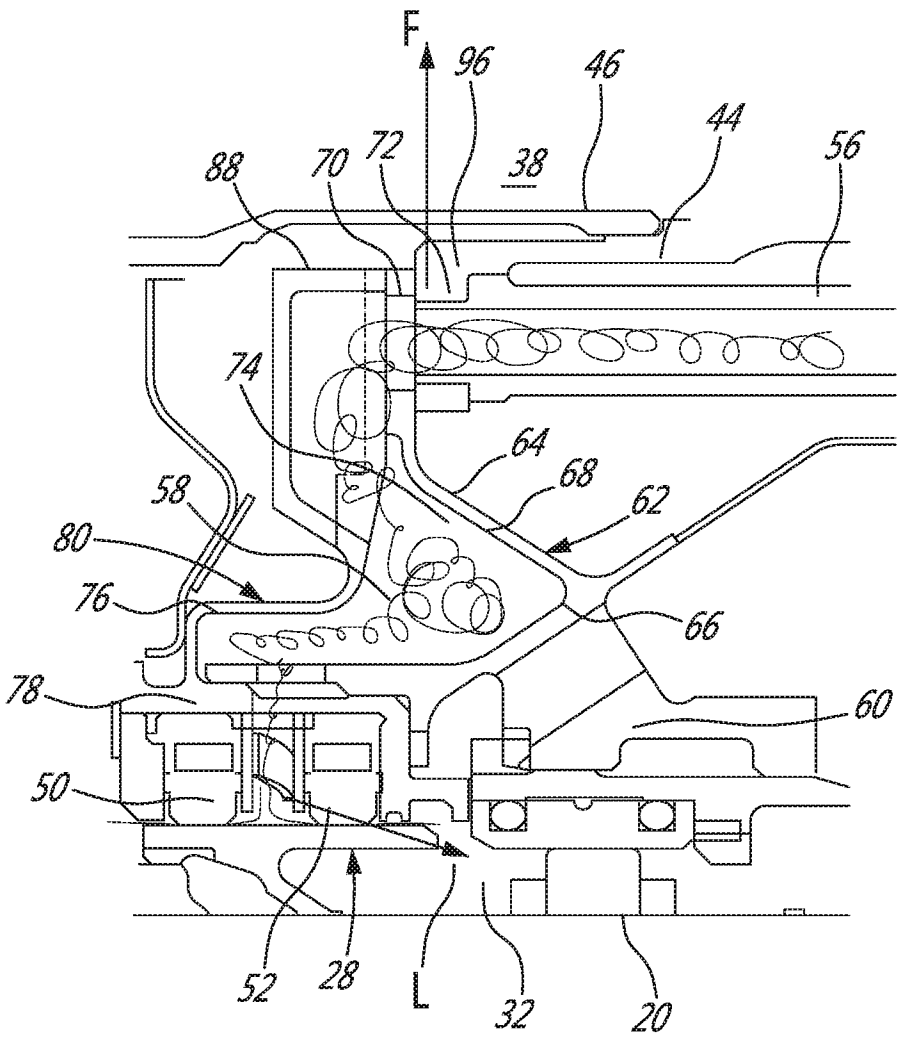
FIG. 2 is cross-sectional view taken along a radial and axial plane, at a circumferential position corresponding to an inlet pipe, showing an example of a structure of the gas turbine engine.

FIG. 2 shows the area of an example gas turbine engine 10 surrounding a bearing 20. In practice, the bearing 20 includes a plurality of roller components distributed annularly around the axis of the rotary shaft. In the cross-sectional view shown in FIG. 2, which is taken along a plane which extends axially and radially, always relative to the axis 11 of the shaft 40, and only shows an upper half portion of the gas turbine engine 10, only one of the roller components is shown.

FIG. 2 shows a duct wall 46 forming a radially internal delimitation to the annular gas path 38. The duct wall 46 forms part of the casing 44. One of the seals 28 is shown, the seal 28 can be seen to include two axially adjacent seal components 50, 52, with a pressure chamber 54 therebetween. The pressure chamber 54 needs to be supplied with pressurized air to apply the positive pressure and leakage flow L across the seal component 52 and into the bearing cavity 32. In this embodiment, there was no pressure source available radially internally to the annular gas path 38, and a feed pipe 56, in combination with a plenum 58 was thus used to supply the pressurized air across the annular gas path 38 and to the pressure chamber 54.

The casing 44 can be structurally connected to the bearing 20, and ultimately to a rotary shaft, via a support structure 62, In this embodiment, the support structure 62 is partially defined by the bearing housing 60 as will be discussed below. The bearing cavity 32 can be fully or partially delimited by the bearing housing 60, such as via a structure made integral thereto.

In this embodiment, the bearing housing 60 has a first wall segment 64 and a second wall segment 66 both extending circumferentially/annularly. The first wall segment 64 has a proximal end structurally joined to the second wall segment 66, and a portion 68 of the first wall segment 64 extends conically, partially radially and partially axially. The first wall segment 64 terminates in a radially-oriented flange 70 at its distal end, which is secured axially against a corresponding radially inwardly oriented flange 72 forming part of the casing 44.

In the embodiment shown in FIG. 2, a pressurized air conduit is provided across the annular gas path 38, leading to the pressurized chamber 54 of the seal 28. In this example, a feed pipe 56 extends across the gas path 38 to this end.

More specifically, the feed pipe is used to bring pressurized air inside a strut extending across the annular gas path 38. The feed pipe 56 is fluidly connected to a plenum 58 which receives the pressurized air from the feed pipe 56 and redistributes it circumferentially around the rotary shaft's axis 11, into the annularly configured seal 28.

Figure 3:
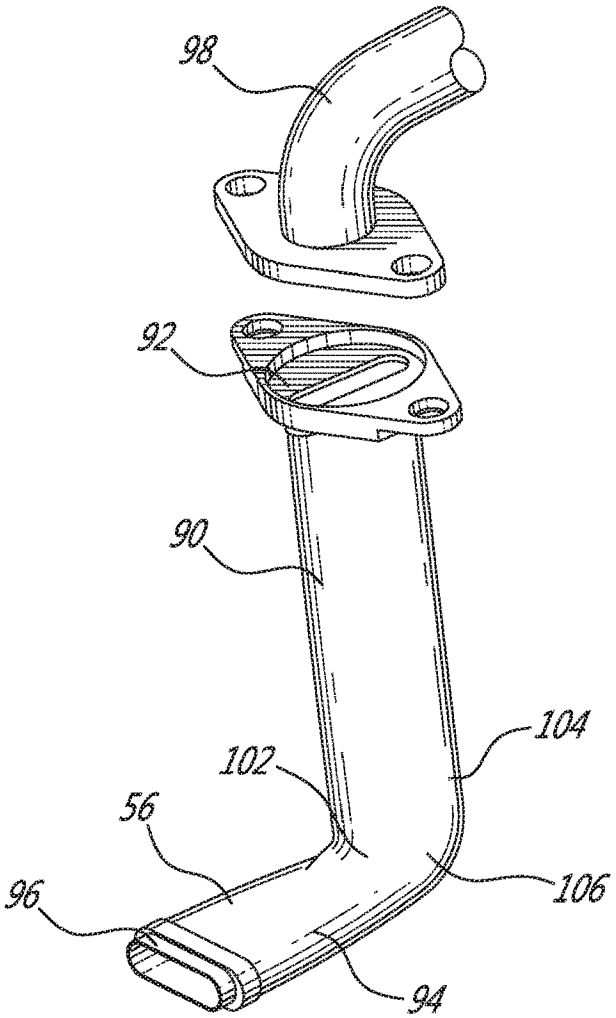
FIG. 3 is an oblique view of a feed pipe.

Referring to FIG. 3, in this embodiment, the feed pipe 56 has a radial portion 90 extending radially inwardly from an inlet end 92, and then turns axially along an axial portion 94 leading to an axially-oriented outlet 96. In this embodiment, the feed pipe 56 provides a first function which is to convey the pressurized air across the gas path 38 and to the plenum 58, and may convey mechanical loads from its attachment point, at the outlet 96, to its inlet end 92, with a limited amount of deformation. This latter optional feature was found useful in this embodiment because it allowed to maintain a gap between the feed pipe and the strut within which it extends in all conditions, and contributed to avoid undesired levels of deformation stemming from mechanical loads. Moreover, an elastomeric hose 98 was used to supply the inlet end 92 of the feed pipe 56, and was secured to the inlet end 92 to this effect, and the structure of the feed pipe 56 was provided in a manner to allow deforming the elastomeric hose 98 when there is a relative displacement, such as a relative displacement between the outlet end 96 of the feed pipe 56 and the radially-outer end of the strut 100, which can occur due to differences in thermal expansion, for instance.

In order for the feed pipe 56 to satisfactorily provide its pressurized air conveyance function, it can be desired to limit the amount of pressure losses which could otherwise occur along the feed pipe 56, and may be shaped as a function of the environment. In this embodiment, this was achieved by providing the radial portion 90 in a shape which is relatively wide and flat relative to a radially and axially extending plane. This may allow a suitable cross-sectional area within the cavity inside the strut 100. On the other hand, the axial portion 94 was provided with a shape which is relatively wide and flat relative to a radially and tangentially extending plane.

Figure 4:
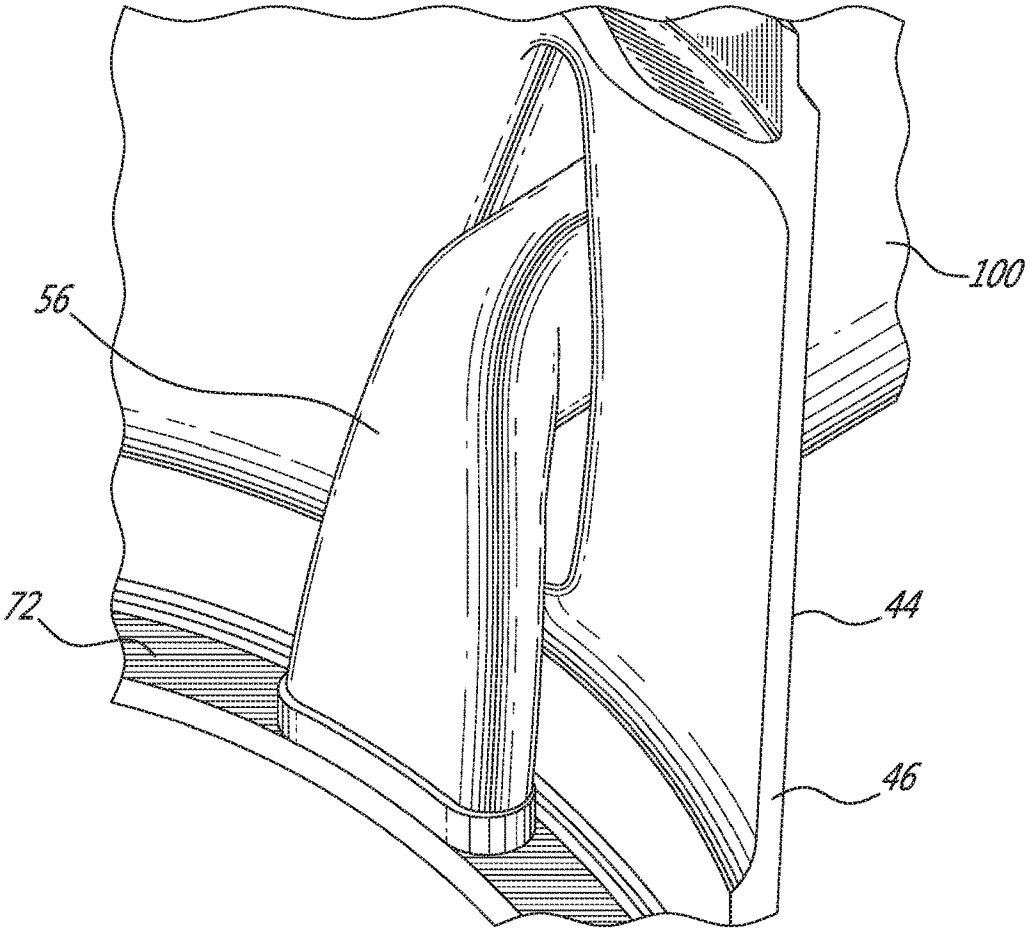
FIG. 4 is an oblique view showing the feed pipe connection to the casing.
Figure 5:
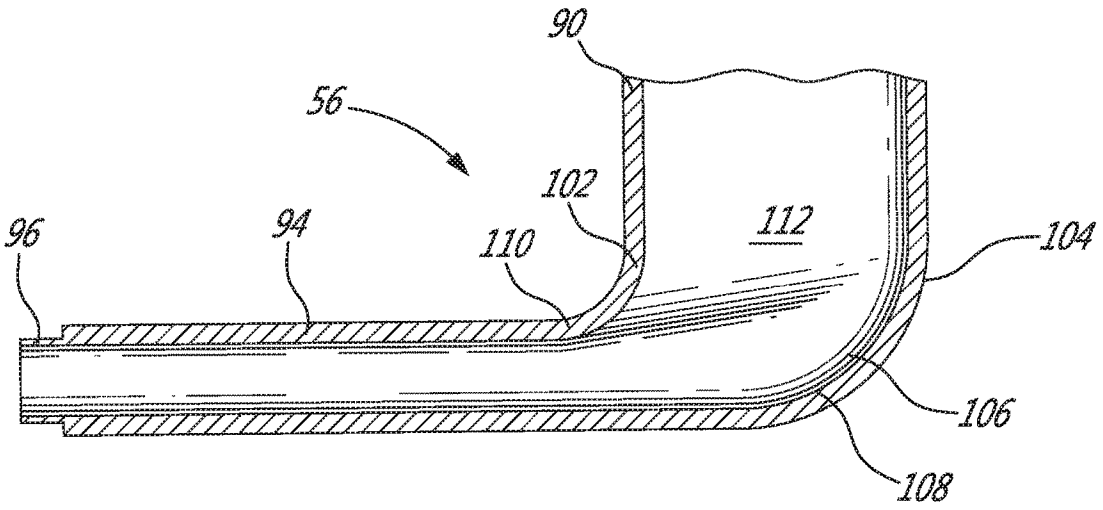
FIG. 5 is a cross-sectional view of the feed pipe, taken along a median, axial/radial plane.

One potential concern from the pressurized air conveyance function standpoint is eventual pressure losses at the junction 102 between the radial portion 90 and the axial portion 94. In this embodiment, the axial portion 94 was provided in a manner to already be wider than the outlet 104 of the radial portion 90 at its receiving end 106, and with a smooth internal radius of curvature at the radially outer wall 108, at the receiving end 106 of the axial portion 94, as best shown in FIG. 5. These features were found to alleviate pressure losses in this turning transition. The axial portion 94 progressively laterally broadens (i.e. generally in a circumferential direction relative to the engine axis) from its receiving end 106 to the outlet 96, as perhaps best seen in FIGS. 3 and 4, which is another feature which was found to alleviate pressure losses. Indeed, if limited radial space is available for the thickness of the axial portion 94, the axial portion 94 can be wide rather than thick, i.e. have a greater circumferential dimension to compensate for the limited radial dimension, while maintaining an amount of flow passage cross-sectional area sufficient to avoid fluid flow inefficiencies where possible. In some alternate embodiments, the axial portion can have even more lateral broadening, in the circumferential direction.

Figure 6:
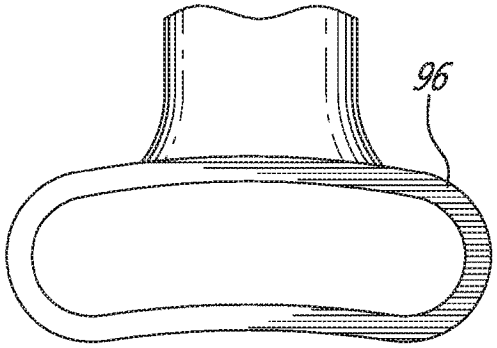
FIG. 6 is a front elevation view of the outlet of the feed pipe.

The outlet 96 of the axial portion 94 is structurally connected to a flange 72 in this embodiment. The flange 72 extends radially and circumferentially. To best adapt to the shape of the flange, the outlet end 96 can be circumferentially curved, such as shown in FIG. 6 The junction between the outlet end 96 and the flange 72 is perhaps best shown in FIGS. 2 and 4. It will also be noted that this circumferential curvature may provide some benefits from the structural point of view, because it can make the axial portion 94 more difficult to "bend" along its length.

In this embodiment, the structure of the feed pipe 56 was designed to suit all operating conditions of the engine, which included covering scenarios where significant relative radial displacement occurred between the outlet end 96 of the feed pipe and the radially-outer end of the strut 100 due to differential thermal expansion. It was desired to maintain a gap between the radial portion 90 of the feed pipe 56 and the inner wall surface of the strut 100 at all times. Moreover, it was desired for the supply conduit 98 leading to the inlet end 92 of the feed pipe 56 to be the yielding (elastically deforming) element upon such relative radial displacement. To this end, the supply conduit 98 was selected to allow for a satisfactory amount of elastic deformability. Moreover, the feed pipe 56, and its structural connection to the casing, was designed to be amongst the most rigid elements in the assembly. In this manner, upon relative radial displacement between the fixation point on the casing, and the radially outer end of the strut 100, the movement of the fixation point on the casing is transferred in a virtually equivalent manner to the inlet end 92 of the feed pipe 56, and the displacement thus transfers a force onto the supply conduit 98, which can be designed to yield. In this specific embodiment, it was decided to make the supply conduit of an elastomeric material to facilitate yielding to the force stemming from the displacement.

The circumferential curvature in the outlet end 96 of the axial portion 94 of the feed pipe 56 can help in providing a satisfactory level of rigidity, for a given wall thickness of the feed pipe 56, because it can make the axial portion 94 of the feed pipe 56 more difficult to bend than a configuration having the same wall thickness, but without the circumferential curvature. One particularly strategic area where wall thickness may be desired to be increased in a manner to increase rigidity is the thickness of the wall at the radially inner wall 110 of the junction, where thickness can be added externally to the pressurized air passage 112, to strengthen the cantilever resistance.

In some embodiments, the feed pipe 56 can be manufactured as a monolithic, integral component, rather than from an assembly of various components, and this can be achieved by moulding, machining, or by additive manufacturing techniques, for instance. The pipe can be made of metal, for instance.

In the example presented above, it will be noted that the feed pipe 56 has a male portion protruding snugly into a correspondingly shaped female aperture defined in the flange 72 of the casing 44. The feed pipe 56 can be brazed or welded in order to secure it into place structurally and in a sealed manner, for instance. In this embodiment, the feed pipe 56 has an outlet end 96 which is secured to a radially oriented flange which is structurally integral to the casing, in occurrence, the radially-inwardly oriented flange 72.

It will be understood by a person having ordinary skill in the art that the expressions "radial" and "axial" as used herein, such as in the expression "the feed pipe has a portion extending radially inwardly across the gas path and then turning axially", are not intended to convey mathematical exactitude, but rather to convey a general sense of orientation, and it will be understood that a certain degree of departure from perfect radial or perfect axial may have little or no effect on the way the feed pipe performs its intended function.

In the example presented above, pressurised air can be conveyed across the gas path via a radial portion of a feed pipe 56, and then turn axially and be conveyed to an outlet via an axial portion of the feed pipe, during operation of the gas turbine engine. If the axial outlet of the feed pipe moves relative to a radially-outer end of the strut, the radial portion of the feed pipe is moved inside the strut while maintaining a gap between the feed pipe and the strut, and the movement can be conveyed to the inlet end of the feed pipe by the structure formed by the feed pipe's body. The supply conduit can then be forced upon by the rigidity of the feed pipe and elastically deformed to accommodate the displacement.

Referring back to FIG. 2, in one embodiment, the duct wall 46 can be an exhaust duct wall, and reach relatively high temperatures, such as around 1200° C., during normal operating conditions. Therefore, the duct wall 46 can be subjected to a strong amount of thermal expansion during normal operation conditions. The bearing 20 can be maintained at a significantly lower temperature. This can be achieved by extracting heat with the oil, or by providing the bearing cavity with cooling air, and the latter can be provided via the leakage flow L, to name one example. Accordingly, there can be a significant difference in thermal growth between the duct wall 46 and the bearing housing 60, and the support structure 62 which connects the casing 44 to the bearing 20 can therefore need to be designed in a manner to accommodate such differences in thermal growth. In this embodiment, the accommodation of differences in thermal growth is achieved by configuring the support structure 62 in a manner to provide structural support and allowing it to deform by the growing annulus of the duct wall 46 as the latter is subjected to the thermal growth.

In this embodiment, such radial stretchability is achieved by incorporating flexible structures shaped as a "hairpin", and more specifically having two segments fully or partially parallel to one another, structurally joined to one another at a proximal end, and having corresponding distal ends which can be stretched apart from one another based on the elastic deformation capability of the material composing at least one of the two segments. In this context, the at least one flexible segment acts partially as structure, offering structural resistance via which the casing 44 is structurally connected to the bearing 20, and partially as a spring, allowing to accommodate the greater thermal growth of the casing 44, or thermal growth difference between the bearing housing 60 and the casing 44, during typical operating conditions.

During typical operation, the higher thermal growth of the casing structure will generate a force F, generally oriented radially outwardly, onto the flange 70 of the first wall segment 64. The first wall segment 64 has a given thickness, which provides it a certain level of rigidity and structural strength to support the rotary shaft within the casing 44. However, given the fact that the thickness is limited, and that it is made of an appropriate material (a metal in this case), the first wall segment has a given amount of elastic deformation capability, allowing it to bend elastically, to a certain extent, as its distal end is pulled radially outwardly relative to its proximal end and relative to the second wall segment 66.

Making the first wall segment 64 thicker will make it stiffer, but at the cost of additional weight. In this embodiment, it was preferred to increase the stiffness, for a given thickness, by orienting the flexing portion 68 of the first wall segment 64 off axial, i.e. to make it conical. Indeed, there is a trigonometric relationship between the amount of radially-imparted flexing ability, and the degree to which the first wall segment 64 is oriented off axial, and closer to radial orientation.

The second wall segment 66 acts essentially as a base structure in this embodiment, and exhibits significantly less flexing ability than the first wall segment 64. This being said, it can nonetheless be said to form a hairpin shape as the second wall segment 66 and the first wall segment 64 are partially parallel to one another, essentially forming a spring, and since the spacing between the wall segments 64, 66 is oriented at least partially axially, the spring ability can operate in the radial orientation of the force F.

It will be noted that in this case, the plenum 58 is formed between a first plenum wall 74 and a second plenum wall 76, both plenum walls 74, 76 being (generally) solid-of-revolution shaped and extending annularly around the axis 11. In this example, both plenum walls 74, 76 are configured in a manner to provide a degree of structure, and a degree of flexibility, and collectively form a radially stretchable support structure 62 in addition to collectively forming a plenum 58 of the pressurized air path. Both plenum walls 74, 76 can be said to have a hairpin shape, even though the hairpins are oriented here in opposite axial orientations. In alternate embodiments, the could be oriented in the same axial orientation, and be roughly offset to one another, for instance.

The first plenum wall 74 can be said to include the first wall segment 64 referred to earlier, and to be structurally integral to the bearing housing 60.

In this embodiment, the seal 28 is provided with a seal housing component 78 which is manufactured separately from the bearing housing 60 though assembled in a manner to be structurally integral to the bearing housing 60. This can facilitate the designing of the plenum 74, as it can, in this manner, naturally be formed out of two separate components, and each plenum wall 74, 76 can be easier to manufacture independently than a monolithic plenum would be to manufacture, the first plenum wall 74 being manufactured with the bearing housing 60 in this case, and the second plenum wall 76 being manufactured as part of the seal housing 78, in this example. This is optional and can vary in alternate embodiments.

Figure 7:
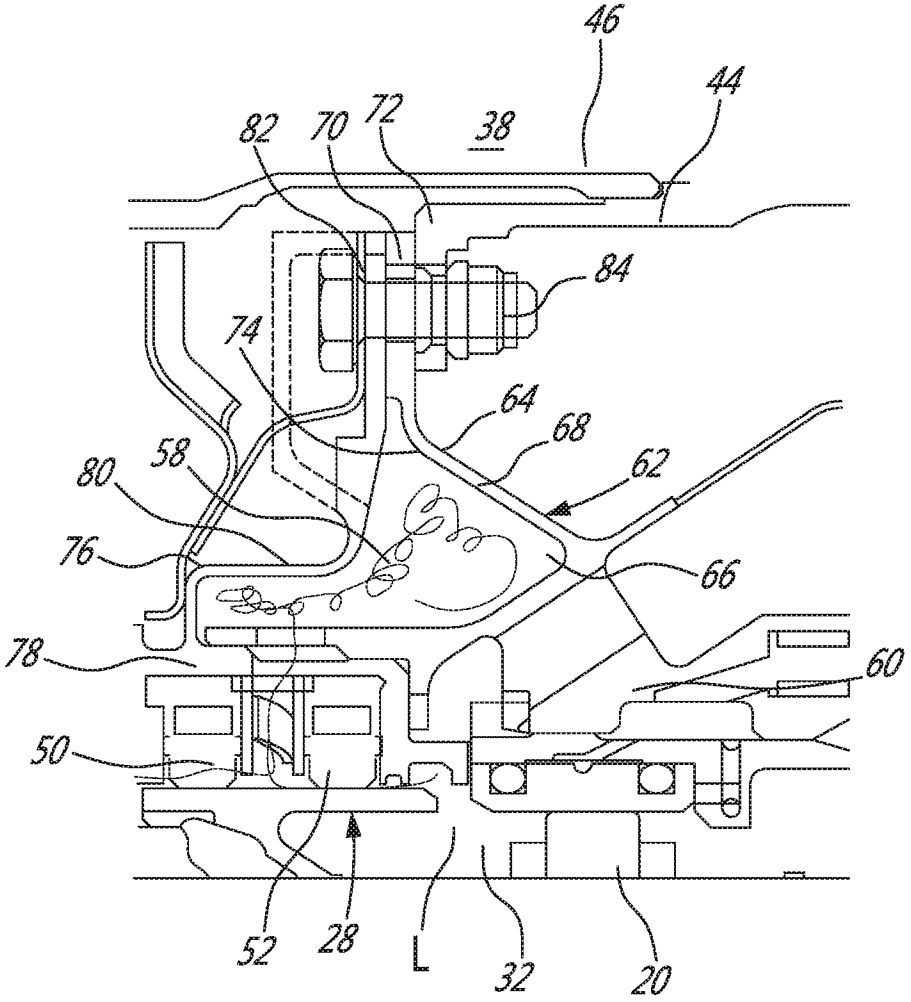
FIG. 7 is a cross-sectional view similar to FIG. 2, but taken at a different circumferential position, away from the inlet pipe.

The second plenum wall 76 can be seen to project radially outwardly from a roughly cylindrical portion of the seal housing, and then curves, leading to a cylindrical flexing portion 80. The cylindrical flexing portion 80 of the second plenum wall 76 (which can alternately be referred to as a third wall segment) is parallel and spaced apart from the cylindrical portion of the seal housing 78, and can flex radially inwardly or outwardly when its distal end is subjected to corresponding forces. The cylindrical flexing portion can lead to another curve, radially outwardly, leading to a flange 82 at its distal end (better seen in FIG. 3), which can be axially secured to the flange 70 of the first plenum wall 64 and to the flange 72 of the casing 46 using fasteners 84, for instance (see FIG. 7, which shows a cross-sectional view similar to FIG. 2 but taken at a different circumferential position, spaced apart from the feed pipe 56). It will be noted that in other embodiments, if more stiffness is desired, it could have been preferred to orient the flexing portion 80 of the second plenum wall 76 obliquely between the axial and radial orientations, for instance (i.e. to shape it conically rather than cylindrically).

It can be desired to make the plenum 58 airtight except for its intended inlet(s) and outlet(s). To this end, a gasket can be used between the flanges 82, 70 of the third wall segment 76 and first wall segment 64, for instance. However, in some other embodiments, using a smooth contact finish between the flanges 82, 70 may be considered to provide sufficient air-tightness for the application considered to avoid recourse to a third sealing component. It will be noted here that depending on the application, more than one feed pipe 56 can be used, and that plural feed pipes can be circumferentially spaced-apart from one another, for instance.

It will be noted that to achieve radial stretchability (and compressibility), the flexible wall portions 80, 68 have a limited thickness, are made of a material exhibiting elastic flexibility, and are oriented at least partially axially. At least partially axially refers to the fact that the orientation is at least partially off from radial, and can even, if found suitable, be completely normal from radial (i.e. perfectly axially oriented/cylindrical).

The presence of two wall segments forming the "hairpin" shape can be optional, and can be omitted on either one, or both, of the plenum walls in some embodiments. Indeed, as long as a flexing portion is provided which extends axially or obliquely between the casing and some form of less flexible support structure leading to the bearing or seal, the desired combined functionality of structural casing/shaft support and radial stretchability may be achieved. In such cases, the wall segment having a flexing portion can be considered, to a certain extent, as being cantilevered from such support structure. In the example presented above, the radially stretchable support structure offers the third functionality of providing a plenum and pressurized air path, which is achieved by using a combination of two plenum walls, but this third functionality may be omitted in some embodiments, in which case a single wall with a flexible portion may be considered sufficient.

In the example presented above, it will be noted that the plenum 58 is provided outside the bearing cavity 32.

Figure 8:
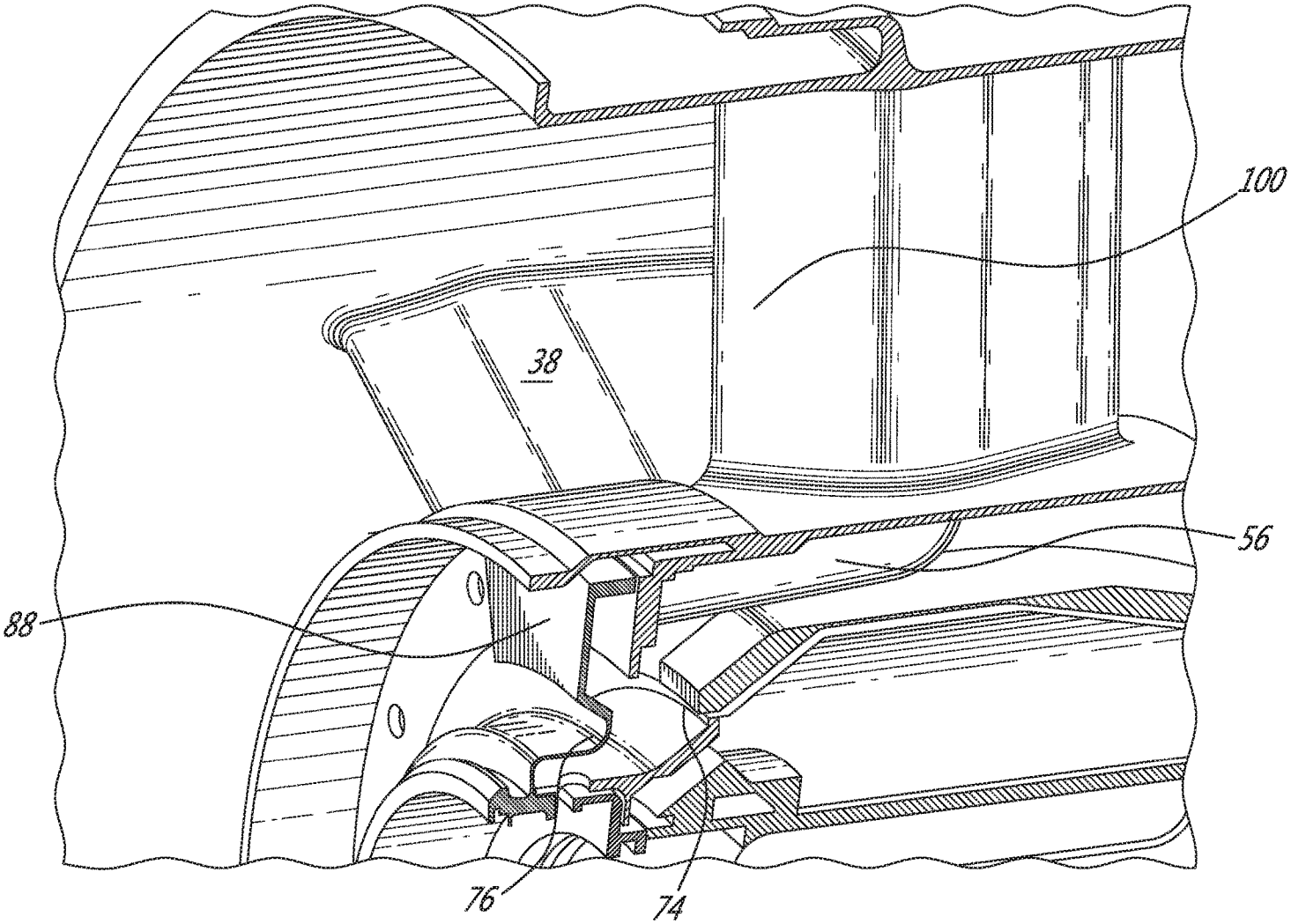
FIG. 8 is an oblique view of the structure of the gas turbine engine.

The oblique view presented in FIG. 8 can help better understand the configuration of a subchamber 88 which is provided at a circumferential position in axial alignment with the feed pipe 56, for axially receiving the pressurized air into a spacing provided between the two plenum walls 74, 76, and to convey this pressurized air to the plenum 58 (also shown in FIG. 2). It will be noted here that the cross-section of FIG. 8 is similar to the cross-section of FIG. 2, in the sense that it is taken across the subchamber 88 and in a manner to show the feed pipe 56. In this embodiment, the subchamber does not extend around the entire circumference, but only along a relatively limited arc, as shown in FIG. 8 and found suitable to perform the function of receiving the pressurized air and conveying it to the main chamber/plenum 58. The main chamber, in this embodiment, extends fully around the circumference, and the regions which are circumferentially outside the subchamber region can be as shown in the cross-section of FIG. 73. Accordingly, a double wall geometry is used to form the plenum 58 external to the bearing seal 28 on 360 degrees, and a subchamber 88 is provided at a given, limited circumferential location, which provides the communication of pressure from the feed conduit 56 to the plenum 58.

The above description is meant to be exemplary only, and one skilled in the art will recognize that changes may be made to the embodiments described without departing from the scope of the invention disclosed. For example, there may be other reasons for using the disclosed geometry, which can provide the combined functions of structure and fluid conduit, than to accommodate a difference of thermal expansions, and therefore, the disclosed geometry may find uses in other sections of a gas turbine engine than the combustor, turbine, or exhaust sections. Still other modifications which fall within the scope of the present invention will be apparent to those skilled in the art, in light of a review of this disclosure, and such modifications are intended to fall within the appended claims.

The invention claimed is:

1. A gas turbine engine comprising an annular gas path including at least a turbine, a rotary shaft mounted for rotation around a rotation axis to a casing via a bearing in a bearing housing, the bearing housing disposed radially inward of the gas path, a cooling air feed pipe having a radial portion extending radially inwardly across the gas path and having an axial portion extending axially to an outlet, the outlet fluidly connected to the bearing housing for feeding cooling air to the bearing housing, the axial portion having a cooling feed conduit cross-section that progressively broadens laterally toward the outlet.

2. The gas turbine engine of claim 1 wherein the gas path extends between a radially inner duct wall and a radially outer duct wall, the gas turbine engine has a plurality of struts extending between the duct walls, the struts circumferentially interspaced from one another, the radial portion of the feed pipe extending in passage formed inside the strut.

3. The gas turbine engine of claim 1 wherein the bearing is enclosed in a bearing cavity at least partially delimited by a bearing seal, further comprising a first plenum wall and a second plenum wall forming a plenum therebetween, the plenum fluidly connecting the feed pipe to the bearing seal, wherein the outlet is structurally connected to the first plenum wall.

4. The gas turbine engine of claim 1 wherein the outlet is structurally connected to a flange and configured to feed cooling fluid across an axial thickness of the flange, the flange extending radially and circumferentially.

5. The gas turbine engine of claim 4 wherein the flange is a casing flange, the casing flange extending radially-inwardly.

6. The gas turbine engine of claim 4 wherein the gas path extends between a radially inner duct wall and a radially outer duct wall, the gas turbine engine has a plurality of struts extending between the duct walls, the struts circumferentially interspaced from one another, the radial portion of the feed pipe extending in passage formed inside one of the struts.

7. The gas turbine engine of claim 6 wherein the structural connection between the outlet and the flange, and the feed pipe, are configured in a manner for relative displacement between the flange and a radially outer end of the strut to be communicated to the inlet end of the feed pipe.

8. The gas turbine engine of claim 7 wherein the structural connection between the outlet and the flange, and the feed pipe, are further configured for a gap to be maintained between the strut and the feed pipe independently of said relative displacement.

9. The gas turbine engine of claim 7 wherein the inlet end of feed pipe is connected to an elastomeric hose.

10. The gas turbine engine of claim 9 wherein the structural connection between the outlet and the flange, and the feed pipe, are further configured for the relative displacement to be communicated to an outlet end of elastomeric hose and to deform said elastomeric hose.

11. The gas turbine engine of claim 1 wherein the radial portion has an outlet end connecting a receiving end of the axial portion, the receiving end of the axial portion being circumferentially broader, relative to the rotation axis, than the outlet end of the radial portion.

12. The gas turbine engine of claim 1 wherein the radial portion is flat relative to an radial/axial plane and the axial portion is flat relative to an axial/tangential plane.

13. The gas turbine engine of claim 1 wherein the radial portion is normal to the axial portion.

14. The gas turbine engine of claim 1 wherein the outlet is circumferentially curved.

15. The gas turbine engine of claim 4 wherein the outlet is circumferentially curved in a manner to match a corresponding radius of curvature of the flange.

16. The gas turbine engine of claim 2, wherein the radial portion of the feed pipe extending in the passage formed inside the strut forms a gap with the inside of the strut.

* * * * *